US009783949B2

(12) United States Patent
Arya

(10) Patent No.: US 9,783,949 B2
(45) **Date of Patent: *Oct. 10, 2017**

(54) SOIL ANCHOR FOOTING

(71) Applicant: Anoop Kumar Arya, Lakelands (AU)

(72) Inventor: Anoop Kumar Arya, Lakelands (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/072,414

(22) Filed: Mar. 17, 2016

(65) Prior Publication Data

US 2016/0208454 A1 Jul. 21, 2016

Related U.S. Application Data

(63) Continuation of application No. 13/707,634, filed on Dec. 7, 2012, now Pat. No. 9,328,474.

(30) Foreign Application Priority Data

Jan. 31, 2012 (AU) ..... 2012900345

(51) Int. Cl.
*E02D 27/50* (2006.01)
*E02D 27/42* (2006.01)
*E02D 5/18* (2006.01)

(52) U.S. Cl.
CPC ..... *E02D 27/42* (2013.01); *E02D 5/18* (2013.01); *E02D 27/50* (2013.01); *E02D 2600/30* (2013.01)

(58) Field of Classification Search
CPC ..... E02D 27/32; E02D 27/42; E02D 27/48; E02D 27/50
See application file for complete search history.

(56) References Cited

U.S. PATENT DOCUMENTS

| | | | |
|---|---|---|---|
| 3,087,308 | A | 4/1963 | Hart et al. |
| 3,918,229 | A | 11/1975 | Schweinberger |
| 4,031,687 | A | 6/1977 | Kuntz |
| 4,290,245 | A | 9/1981 | Pardue, Jr. et al. |
| 4,659,256 | A | 4/1987 | Bullivant |
| 4,742,656 | A | 5/1988 | Farmer |

(Continued)

FOREIGN PATENT DOCUMENTS

FR 2430495 2/1980

*Primary Examiner* — Frederick L Lagman
(74) *Attorney, Agent, or Firm* — Law Offices of Steven W. Weinrieb

(57) ABSTRACT

The present invitation relates to a soil anchor footing supporting system within the ground surface to support steel or concrete column, brick or block wall, light post, sign post, substation equipment, pre-cast panel, retaining wall etc. It comprises of a footing slab (2) made of concrete; plurality of deformed steel bars (1) or fiber reinforced polymer (FRP) bars embedded in the lower surface of the concrete slab (2) and plurality of anchor bolts (4) or reinforcing starter bars which are embedded into upper surface of concrete slab (2) to suit steel or concrete column. The bars, which act as mini piles, are configured for ground penetration and a concrete slab is cast on top to encase all the bars and is capable of holding desired loads. These footings can be cast-in-situ type where the bars are pushed into ground (3) individually or in groups and concrete is cast on top, or it can be pre-cast type where, the whole footing is pushed into ground using pile driving equipment or mobile press.

18 Claims, 5 Drawing Sheets

(56) References Cited

U.S. PATENT DOCUMENTS

| | | | |
|---|---|---|---|
| 4,918,891 | A | 4/1990 | Gerszewski |
| 5,039,256 | A | 8/1991 | Gagliano |
| 5,257,489 | A | 11/1993 | Angelette |
| 5,749,198 | A | 5/1998 | Johnson |
| 5,873,679 | A | 2/1999 | Cusimano |
| 5,878,540 | A | 3/1999 | Morstein |
| 5,924,264 | A | 7/1999 | Vierra |
| 5,931,604 | A | 8/1999 | Queen et al. |
| 6,012,874 | A | 1/2000 | Groneck et al. |
| 6,435,777 | B1 | 8/2002 | Yoshii et al. |
| 6,578,333 | B1 | 6/2003 | Gagliano |
| 6,665,990 | B1 | 12/2003 | Cody et al. |
| 6,910,832 | B2 | 6/2005 | Gagliano et al. |
| 7,073,980 | B2 | 7/2006 | Merjan et al. |
| 7,076,925 | B2 | 7/2006 | Gagliano |
| 7,308,776 | B2 | 12/2007 | Ray et al. |
| 7,533,505 | B2 | 5/2009 | Henderson |
| 7,549,259 | B2 | 6/2009 | Calle |
| 7,618,217 | B2 | 11/2009 | Henderson |
| 8,037,651 | B2 | 10/2011 | Dent |
| 9,328,474 | B2 * | 5/2016 | Arya ..... E02D 5/18 |
| 2003/0196393 | A1 | 10/2003 | Bowman et al. |
| 2004/0131428 | A1 | 7/2004 | Henderson |
| 2005/0025577 | A1 | 2/2005 | Gagliano et al. |
| 2005/0141969 | A1 | 6/2005 | Gregory et al. |
| 2007/0280787 | A1 | 12/2007 | Snyder |
| 2008/0302028 | A1 | 12/2008 | Lewenhoff |
| 2012/0070233 | A1 | 3/2012 | Wang et al. |
| 2012/0096786 | A1 | 4/2012 | Salisbury et al. |

* cited by examiner

SOIL ANCHOR FOOTING

CROSS REFERENCE TO RELATED PATENT APPLICATIONS

This patent application is related to, and based upon, Australian Provisional Patent Application Number 2012900345 filed Jan. 31, 2012, and U.S. patent application Ser. No. 13/707,634 filed on Dec. 7, 2012, now U.S. Pat. No. 9,328,474 which issued on May 3, 2016, both applications or patents of which are incorporated by reference herein and the priority benefits of which are hereby claimed.

FIELD OF THE INVENTION

The present invitation relates to a soil anchor footing, and more particularly for a foundation supporting system within the ground surface for columns, walls, light posts, sign posts, electrical substation equipment, railway infrastructure, light industrial structures, or the like, and a method for making the same.

BACKGROUND OF THE INVENTION

The advent of technology has led to a sea change in the civil engineering construction industry. Foundation support systems for the columns of buildings are characterized by suitable footings based upon the soil condition. A footing is basically an enlarged base for a foundation which is designed to distribute the building load over a larger area of soil and to provide a firm, level surface for constructing the structures. The purpose of the footing is to also provide stability to the structure against swaying or falling due to horizontal forces, such as, for example, high velocity or turbulent winds. In the present invention, the anchors play an important role. The primary function of these anchors is to transmit upward and downward forces, due to column axial load and overturning moments, to the soil at certain depths below the ground.

The depth of the excavation is determined by the structural engineer depending upon the type of soil where the construction is to occur. Surface soil is removed so as to expose the soil that is to be compacted enough so as to bear the load of the column/structure. The depth of the excavation will be just deep enough to place the footings. The footings are poured concrete that help to spread the weight of the structure, walls, piers, columns, light post structures, and the like. The total area of the footings is roughly determined by dividing the total load, including an estimated mass for the footing itself, by the soil bearing capacity.

Concrete is one of the best footing materials because it is hard, durable, and strong in compression. It is easily cast into the unique shapes required for each type of footing. Alternatively, footings can be cast directly within the trench. While this saves the cost of footing forms, care must be taken so that no soil from the sides is mixed in the concrete. Footings can also be piles, bored piers, or of the raft slab type.

Several of the problems being addressed by the present invention is to have the footing that will be light in weight, economical, environmentally friendly, easy to construct, able to be formed relatively quickly, and will require less space as compared to conventional pad type footings. Here the footing forces are resisted by closely spaced deformed steel bars driven into the soil. The steel bars act like mini piles, resisting uplift and downward forces.

In connection with conventional type pad footings, if the vertical loads are relatively small, any overturning moments are resisted by means of the weight of the footing. Hence, it requires large volumes of concrete, more space, more excavation, and more soil disposal. Examples are light posts, substation electrical equipment supports, sign posts, and the like. In accordance with the present invention, the column vertical load and overturning moments are resisted by means of steel bar soil anchors, and by means of their upward and downward load capacity within the soil. The soil anchor footing requires minimum excavation, less soil disposal, is relatively light in weight, requires less space, saves construction time, and provides much higher overturning moment-resistant capacity.

Though the aforenoted conventional and similar systems have been designed to provide certain advantages, they also suffer from various shortcomings. A few of such prior art systems are discussed hereinbelow so as to help distinguish the present invention from such known prior art systems.

U.S. Pat. No. 4,290,245 discloses an earth anchor for embedding the same within the ground and to acquire a secure and snug retention incorporating a shank portion having a helical blade affixed thereto and having a linear cutting edge positioned at a lagging angle off the perpendicular or radius from the shank portion.

Similarly, U.S. Pat. No. 4,742,656 relates to an earth anchor for embedding the same within the ground and incorporating a helical blade(s), having flattened side edges, intervened by rounded or accurate corners, and connecting with its shank for securing with any driving apparatus useful for the power driving of such an earth anchor into the ground.

Both of the anchors disclosed within these prior art patents, however, are expensive and need special machinery to install. They also need a reinforced concrete footing slab to be cast on top of these screw anchors.

In accordance with the present invention, however, steel deformed bars are being used which are readily available, are inexpensive, and are easy to install. The pre-cast type footing in accordance with the present invention can be installed within the ground within a few minutes. As the bars are driven into the ground, they have much higher uplift and downward force resistant capacity than screw type anchors. Furthermore, recycled bars can also be used which will be even cheaper, and moreover, such helps to protect environment since recycled materials are being used. Also, within the soil anchor footing, no additional reinforcement is required within the top slab.

U.S. Pat. No. 5,873,679 discloses a foundation pier adapted to be secured to a support beam of a movable dwelling for supporting the dwelling and for resisting seismic forces applied to the dwelling. It appears that this foundation pier has limitations as to its applications and can be used only for small loads. The present invention, however, is more versatile, can be used for higher loads, and thereby has broader applications.

U.S. Pat. No. 5,924,264 relates to a foundation system comprising a pre-fabricated set of concrete forms for a manufactured building that is already on-site and in-place. The concrete form set includes standard-length sections that bolt together immediately below the rim of the manufactured building. This invention has a specific use like in the case of pre-fab building wall foundations. The present invention, however, discloses a different product and has broader applications.

U.S. Pat. No. 7,308,776 discloses a pole anchor footing system for effectively supporting a post structure within a ground surface. The pole anchor footing system includes a resilient body having a neck portion and a base portion, and an elongate member extending into the body from an upper end of the body. In accordance with the present invention, the footing gets its strength from the anchor bars that are embedded within the ground, while in the prior art, the footing obtains its strength from its pyramidal shape. This has very limited applications when compared to those of the present invention.

U.S. Pat. No. 7,549,259 pertains to a device for creating a footing for a structure including a reinforcing member having a base extending in a first direction, and a leg extending in a second direction, and it is concerned with fence post footings as part of a retaining wall, secured by horizontal anchors. Hence, this device again has limited use. At the same time, the proposed invention is structurally different from the prior art and it also has broader applications.

U.S. Pat. No. 8,037,651 discloses a ground anchor assembly which includes at least two threaded studs, and an anchor plate having at least two openings of appropriate size and shape to receive the at least two threaded studs. The patented system is concerned with installing anchor bolts into concrete in such a way that their alignment is intact. A completely different product is envisaged by the present invention which has broader applications.

Lastly, US 2008/0302028 discloses a ground anchor which comprises an anchoring screw having a screw flight extending around a screw axis wherein the screw flight is generally rigid with some lateral resilient flexibility. This system has the inherent disadvantage of being cumbersome and expensive. But in accordance with the present invention, steel deformed bars are being used which are readily available and are relatively inexpensive. They are also easy to install. The pre-cast type footing in accordance with the present invention can be installed within the ground in one operation and within a few minutes, and is a complete product, as opposed to the prior art system wherein the same requires the casting of a reinforced concrete slab on top of screw anchors.

SUMMARY OF THE INVENTION

Briefly, in accordance with the principles and teachings of the present invention, the soil anchor footing comprises the use of steel deformed bars which act as mini piles. Having deformed surfaces, the bars have high soil adhesion, hence, more uplift and downward force resistance capacity. The bars are closely spaced, 100 mm to 300 mm center-to-center spacing therebetween, so that the footing requires a smaller space. Since the bars are pushed into the ground, very small excavations are required to accommodate the same, only the footing top slab being required, thereby resulting in less soil disposal. The footing can also be of the pre-cast type, wherein the whole footing can be installed within the ground by pile driving equipment or a mobile press, making the construction work very fast and simple.

The proposed invention comprises a soil anchor footing as well as a method for making the same. This is a special type of footing which can be cast-in-situ or may be of the pre-cast type. In the cast-in-situ type, 150 mm to 350 mm is excavated within the ground so as to accommodate the top slab. Deformed steel bars of 12 mm to 36 mm size, 0.3 m to 2 m long, are then pushed into the ground in accordance with a predetermined grid pattern. A concrete slab of about 200 mm to 400 mm thick is then cast on top of the bars so as to effectively encase all of the bars, and hold-down bolts which can also be chemically or mechanically secured over the slab. In the pre-cast type, the whole footing is made in the factory or within a controlled environment. The deformed bars are cast into the concrete slab in a grid pattern. Once the concrete is cured so as to achieve its full strength, it is brought to the site. The footing is placed over the excavated area with the bars extending downwardly into the ground and with the slab disposed atop the bars. It is then pushed into the ground using pile driving equipment or a mobile press. The hold-down bolts can be part of the pre-cast concrete slab or can be chemically or mechanically secured over the concrete slab later on. The footing in accordance with this is invention is ideal to support building columns, masonry walls, or similar structures, such as, for example, light poles, sign posts, substation electrical equipment supports, and the like.

This footing is light in weight, economical to produce, environmentally friendly, easy to construct, saves time in both manufacture and installation, and requires less space as compared to conventional pad type footings.

BRIEF DESCRIPTION OF THE DRAWINGS

These and other features, aspects, and advantages of the present invention will become better understood when the following detailed description is read with reference to the accompanying drawings. Like reference numerals indicate corresponding parts throughout the various drawing figures:

FIG. 3 is a top plan view of a second embodiment of a soil anchor footing as constructed in accordance with the principles and teachings of the present invention, wherein the concrete slab is effectively transparent so that one can appreciate the grid pattern defining the location of the anchors bars, having their upper portions encapsulated by the concrete slab, as the anchor bars are disposed within the ground, and wherein FIG. 3 illustrates a soil anchor footing which comprises a masonry wall soil anchor footing;

FIG. 5 is a top plan view of a third embodiment soil anchor footing as constructed in accordance with the principles and teachings of the present invention, wherein the concrete slab is effectively transparent so that one can appreciate the grid pattern defining the location of the anchor bars, having their upper portions encapsulated by the concrete slab, as the anchor bars are disposed within the ground, and wherein FIG. 5 illustrates a soil anchor footing which has a stepped configuration with a pedestal portion disposed at the center of the footing;

FIG. 7 is a top plan view of a fourth embodiment of a soil anchor footing as constructed in accordance with the principles and teachings of the present invention, wherein the concrete slab is effectively transparent so that one can appreciate the grid pattern defining the location of the anchor bars, having their upper portions fixedly disposed within the concrete slab, as the anchor bars are disposed within the ground, and wherein FIG. 7 illustrates a soil anchor footing wherein the upper portions of the anchor bars are fixedly secured within the concrete slab by means of a suitable epoxy or other chemical adhesive;

FIG. 10 is a top plan view of a fifth embodiment of a soil anchor footing as constructed in accordance with the principles and teachings of the present invention, wherein the concrete slab is effectively transparent so that one can appreciate the grid pattern defining the location of the anchor bars, having their upper portions disposed within the concrete slab, as the anchor bars are disposed within the ground, and wherein FIG. 10 illustrates a soil anchor footing wherein the anchor bars are disposed within oversized holes formed within the concrete slab with the uppermost portions of the anchor bars being threaded and protruding above the upper surface portion of the concrete slab so as to be secured thereto by means of suitable nut and washer assemblies;

DETAILED DESCRIPTION OF THE ILLUSTRATED EMBODIMENTS

Figure 1:
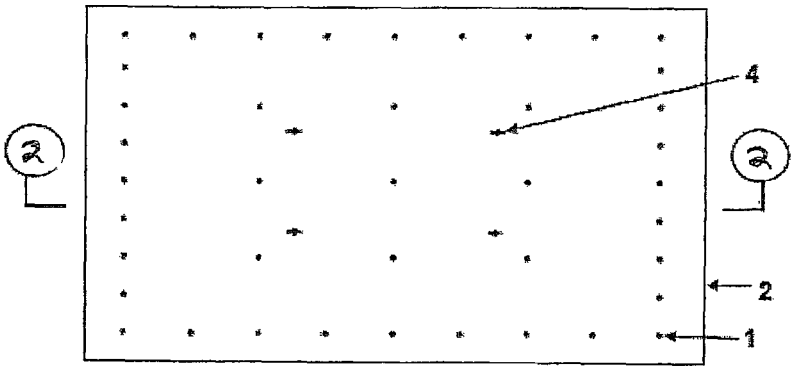
FIG. 1 is a top plan view of a first embodiment of a soil anchor footing as constructed in accordance with the principles and teachings of the present invention, wherein the concrete slab is effectively transparent so that one can appreciate the grid pattern defining the location of the anchor bars, having their upper portions encapsulated by the concrete slab, as the anchor bars are disposed within the ground.
Figure 2:
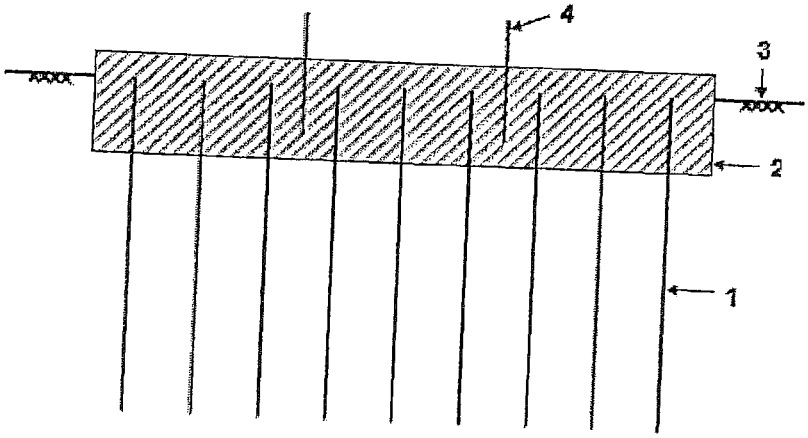
FIG. 2 is a cross-sectional view of the soil anchor footing of FIG. 1 as taken along the lines 2-2 of FIG. 1.

In connection with a first embodiment of a soil anchoring footing as constructed in accordance with the principles and teachings of the present invention, the first embodiment soil anchoring footing is illustrated in FIGS. 1 and 2. This type of footing can be constructed in two ways—as a cast-in-situ type, and as a pre-cast type. In connection with the cast-in-situ type, the ground is first excavated for the top slab, 150 mm to 350 mm deep, depending upon the thickness of the slab. After this, about 0.3 m to 2 m long deformed steel or fiber reinforced polymer (FRP) anchor bars 1, 12 mm to 36 mm diameter, are pushed individually into the ground 3 by means of an industrial hammer, or in groups, using pile driving equipment or a mobile press, leaving approximately 150 mm to 350 mm of the upper portions of the anchor bars 1 exposed above ground. As the anchor bars 1 have deformed surfaces, and as they are pushed into the ground 3, they exhibit good soil anchorage capacity resulting in high downward and uplift resistance capacity. The anchor bars 1 can be placed in a grid pattern with the spacing between adjacent anchor bars, disposed around the perimeter of the grid pattern, being 100 mm to 300 mm and wherein the grid pattern covers a planar area of approximately 0.3 m×0.3 m to 1 m×1 m. In addition, the anchor bars 1 are also dispersed throughout the interior portion of grid pattern in accordance with a second grid pattern wherein the anchor bars 1 are spaced from each other through means of larger predetermined distances, as can readily be seen from FIG. 1. While a particular grid pattern has been illustrated, it is to be appreciated and understood that this pattern is only exemplary, and that the anchor bars 1 can be located and spaced in accordance with other grid patterns depending upon various different factors unique to a particular construction site.

Once all of the anchor bars 1 are embedded within the ground 3, a 200 mm to 400 mm thick concrete slab 2 is cast over these bars so as to encase the exposed upper 150 mm to 350 mm portions of the anchor bars 1 within the concrete slab 2 such that approximately 50 mm of the concrete slab 2 is disposed above the upper portions of the anchor bars 1. In this manner, all of the anchor bars 1 are effectively connected together. The concrete slab 2 is cured for approximately 7 days. After this, chemical or mechanical anchor bolts, hold-down bolts, or starter bars 4 are appropriately affixed into concrete slab 2 so as to accommodate an upstanding steel or concrete column. This concrete slab has no limitation in size and shape. It can be of 0.3 m to 10*m* in width or diameter. Hence, it can serve a multiplicity of advantages and has diverse flexibility.

Figure 3:
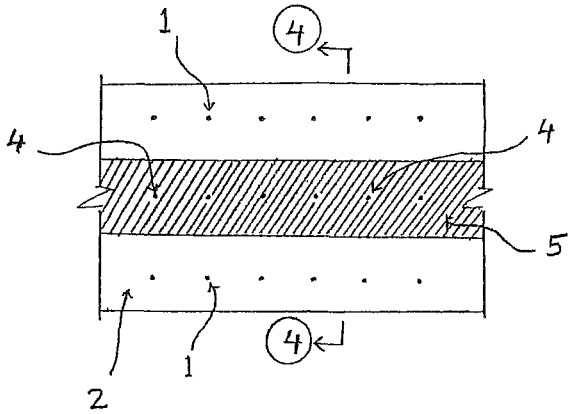
Figure 4:
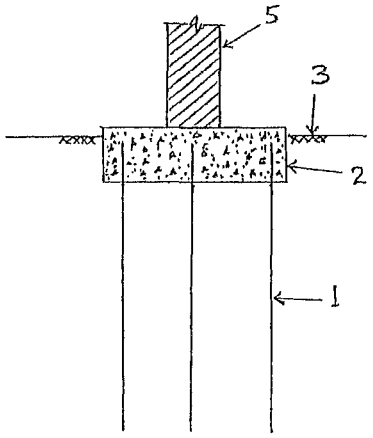
FIG. 4 is a cross-sectional view of the masonry wall footing of FIG. 3 as taken along the lines 4-4 of FIG. 3.

With reference now being made to FIGS. 3 and 4, a second embodiment of a masonry wall footing is disclosed, wherein a concrete column, brick or block wall 5 has effectively been constructed atop a soil anchor footing similar to the footing disclosed within FIGS. 1 and 2.

Generally, chemical and mechanical anchor bolts 4 can be secured within the concrete slab 2 as per the manufacturer's recommendations. In connection with the use of such anchor bolts 4, holes are drilled into the concrete slab 2 and the anchor bolts 4 are inserted. The anchor bolts 4 are bonded into the concrete slab 2 by means of chemical adhesives, or by means of friction as the anchor bolts 4 expand when tightened as is known in the art, or still further, they can be screwed into the concrete slab 2 using ferrules, not shown. The anchor bolts 4 can also be of the cast-in-situ type. In that case, they are mild steel bars 4 with threaded tops, and cogs or hooks at their base portions so as to be cast along with concrete slab 2.

Similarly, upstanding reinforcing starter bars 4 for the concrete column or brick or block wall 5, can be installed by drilling holes within the concrete slab 2 using suitable chemical adhesives similar to those used within the chemical anchors. They can also be of the cast-in-situ type with cogs or hooks on their bases.

The footing can also be of the pre-cast type. In this case, the entire footing is made in a factory or controlled environment. In this case, the footing is cast with deformed steel or fiber reinforced plastic (FRP) anchor bars 1 embedded within the concrete slab 2 as shown in FIG. 1. A ferrule may be cast at the center of the footing for lifting purposes. Once the concrete slab 2 has been cured and has achieved full strength, the footing is brought to the construction site. The ground 3 is excavated for the top slab 2, 150 mm to 350 mm deep, depending upon the slab thickness. The pre-cast footing is then placed over the excavated ground with the anchor bars 1 extending downwardly into the ground 3 while the concrete slab 2 is disposed atop the ground 3. The anchor bars 1 are then pushed into the ground 3 by applying a uniform load over the concrete slab 2 using pile driving equipment or a mobile press until the top of the concrete slab 2 is approximately 50 mm above the ground 3. Care should be taken not to damage the concrete slab 2, while installing the footing into the ground, by using timber pieces or any buffer on top of the concrete slab 2. The hold-down bolts or reinforcing starter bars 4 are then subsequently inserted into concrete slab 2 by means of any of the aforementioned methods. The footing can be 0.3 m to 1 m square, or alternatively can be rectangular or of any other configuration. This type of footing has size limitations in view of the fact that large footings will be difficult to be installed as a whole and with uniform pressure. The advantage of this structure, however, is that it is quicker to construct or erect.

The ground is tested to determine the uplift and downward load capacity resistance or support of the deformed bars within the soil. The footing size, slab thickness, concrete strength, bar diameter, number of bars, spacing between adjacent bars, and the depth to which the deformed bars are embedded within the ground 3 as required for a proper footing structure are worked out based upon column base forces and structural engineering principles, or structural analysis software packages. Outer anchor bars 1 can be spaced closer together as they are more effective in resisting overturning moments. The footing slab has a substantially flat configuration with a planar upper surface and an opposing mutually parallel planar lower surface, wherein such surfaces are capable of holding or supporting the desired loads.

Figure 5:
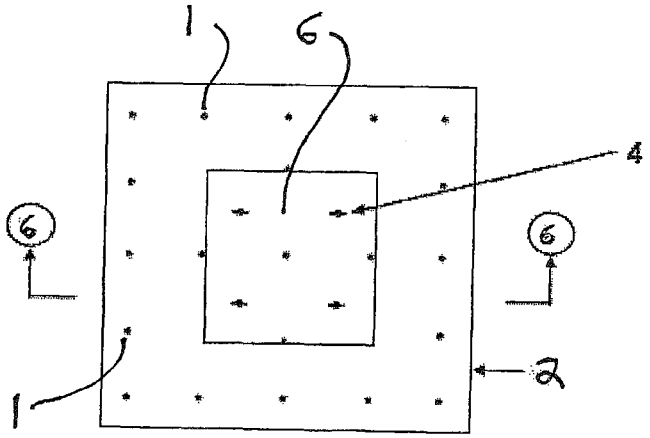
Figure 6:
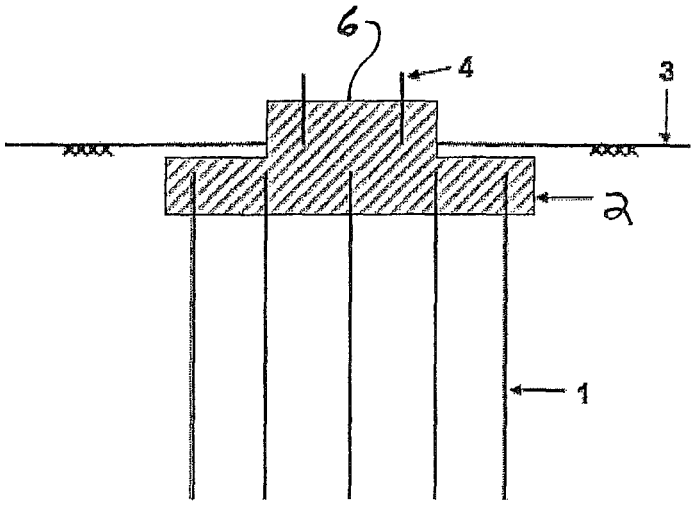
FIG. 6 is a cross-sectional view of the soil anchor footing disclosed within FIG. 5 as taken along the lines 6-6 of FIG. 5.

In accordance with yet another embodiment utilizing the principles and teachings of the present invention, the concrete slab 2 can be constructed so as to effectively have a stepped configuration with a pedestal portion 6 at the center thereof as is illustrated in FIGS. 5 and 6. This is a very optimal structural configuration in that such will also facilitate the application of a uniform centralized pressure to be impressed upon, over, or across the pedestal in the pre-cast footing case so as to be capable of inserting the footing into the ground 3 in a much easier manner.

Figure 7:
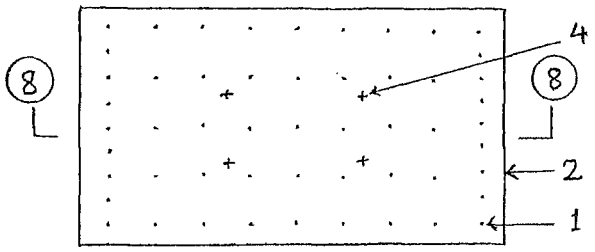
Figure 8:
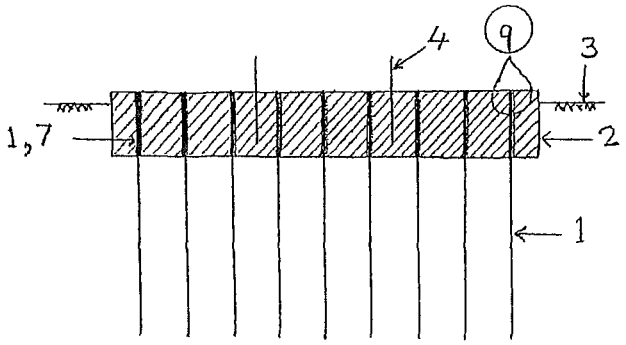
FIG. 8 is a cross-sectional view of the soil anchor footing as disclosed within FIG. 7 and as taken along the lines 8-8 of FIG. 7.
Figure 9:
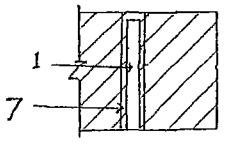
FIG. 9 is an enlarged cross-sectional view of the encircled portion labeled 9 in FIG. 8.

In yet another embodiment constructed in accordance with the principles and teachings of the present invention, and as illustrated within FIGS. 7-9, the top concrete slab 2 is pre-cast type with through-holes formed therein which are effectively oversized by, for example, 4 to 8 mm in diameter, with respect to the diametrical extents of the anchor bars 1 so as to receive or accommodate the upper portions of the anchor bars 1 in a relatively easy manner. The concrete slab 2 is placed over excavated ground 3 and therefore acts like a template for receiving the anchor bars 1. Coarse sand can be screeded over the excavated portion of the ground 3 so as to make it level before placing the concrete slab 2 upon the excavated portion of the ground 3. The anchor bars 1 are then inserted into the ground 3 through the holes in the concrete slab until the upper portions of the anchor bars 1 are disposed flush with, or just slightly below, the upper surface portion of the concrete slab 2. Once all of the anchor bars 1 are inserted through the concrete slab 2 and disposed within the ground 3 at the predetermined level, the bores around the bars are filled with epoxy grout or another suitable chemical adhesive 7 so as to secure the anchor bars 1 within the concrete slab 2. The anchor bolts 4 can be part of a pre-cast slab, or can be installed later as noted hereinbefore. The excavated portion of the ground disposed around the top of the concrete slab 2 should be back-filled with compacted soil or concrete. This soil anchor footing has no size limitation in view of the fact that the entire footing has been deposited within excavated ground and has not been force-fully pushed into the ground, and the concrete slab 2, having been pre-cast, also saves curing time on site.

Figure 10:
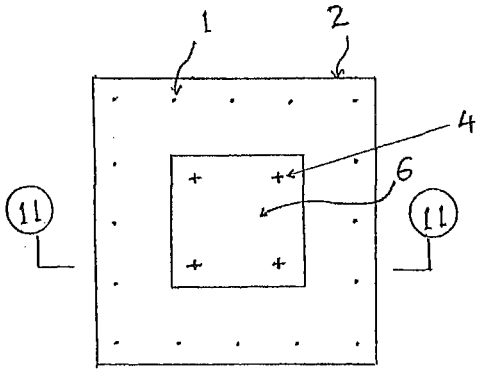
Figure 11:
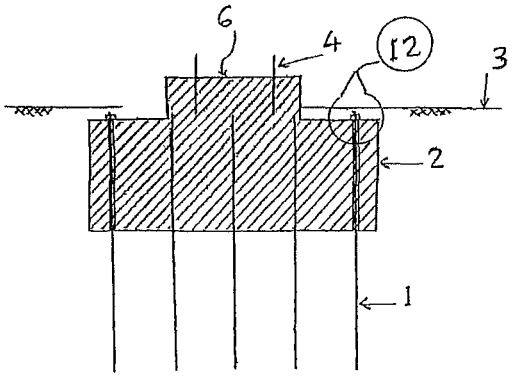
FIG. 11 is a cross-sectional view of the soil anchor footing as disclosed within FIG. 10 and as taken along the lines 11-11 of FIG. 10.
Figure 12:
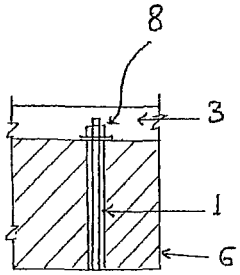
FIG. 12 is an enlarged cross-sectional view of the encircled portion labeled 12 in FIG. 11.

With reference lastly being made to FIGS. 10-12, a fifth embodiment of a soil anchor footing is disclosed. It is to be appreciated that this fifth embodiment soil anchor footing is somewhat similar to the third embodiment of the soil anchor footing as disclosed within FIGS. 5 and 6 in that it has a stepped configuration with a pedestal portion 6 at the center thereof, and in addition, this fifth embodiment of a soil anchor footing is likewise similar to the fourth embodiment of the soil anchor footing as disclosed within FIGS. 7-9 in that the concrete slab 2 is provided with relatively oversized diametrically dimensioned holes or bores in order to receive and accommodate the anchor bars 1.

The significant difference, however, between the fifth embodiment soil anchor footing as disclosed within FIGS. 10-12 and the third embodiment soil anchor footing as disclosed within FIGS. 7-9, resides in the fact that the upper portions of the anchor bars 1 are not actually fixed along the axial lengths of the upper portions of the anchor bars 1 to the concrete slab 2. To the contrary, the uppermost portions of the anchor bars 1 protrude above the upper surface portion of the concrete slab 2, the uppermost portions of the anchor bars 1 are externally threaded, and nut and washer assemblies 8 are threadedly secured upon such externally threaded upper portions of the anchor bars 1 so as to fixedly secure the upper portions of the anchor bars 1 to the upper surface portion of the concrete slab 2. The annular portions of the through-bores, disposed around the anchor bars 1, can be filled with a suitable sealant or the like so as to prevent corrosion of the anchor bars 1, and the nut and washer assemblies 8 should be fabricated from stainless or galvanized steel. It can therefore be further appreciated that the anchor bars 1 are effectively movable with respect to the concrete slab 2 should the concrete slab 2 undergo movement or support load forces acting downwardly thereon. However, should the concrete slab 2 tend to move upwardly relative to the anchor bars 1, the anchor bars 1 will impress uplift resistance forces upon the concrete slab 2 so as to effectively prevent the concrete slab 2, and the structure supported thereon, from undergoing upward, falling, or lateral movements that may be encountered due to forces within the earth, or from horizontal wind forces, and the like. This is particularly useful for strengthening of existing pad footing for uplift or overturning moment resistance capacity.

Deformed reinforcing bars, also known as rebar, are very common in the construction industry. They are used in concrete columns, beams, floor slabs, and the like. A pattern is formed within the external surface portions of the bars which helps the concrete to adhere to or grasp the bars. The exact patterns are not specified, but the spacing, number and height of the bumps are in accordance with known standards. Because of the grooves on their surface, they have much better bonding with concrete compared to plain round bars. Furthermore, it is known that deformed bars have strength values of 500 MPa (megapascals) as opposed to strength values of 250 MPa characteristic of plain bars. They are normally manufactured in 6 m or 12 m lengths, however, they can readily be cut to any length as per the building requirements.

The aforenoted footings are smaller in size, lighter in weight, and have higher uplift force and overturning moment resistance capacities compared to conventional concrete pad type footings. The footings will also incur less settlement compared to conventional pad footings.

The aforenoted footings can be quite economical where column vertical loads are small and overturning moments are high, such as, for example, in connection with electrical substation minor equipment footings, sign posts, light poles, and the like. The footings can also be more suitable where access is tight and excavation can disturb neighboring footings.

The aforenoted footings are also environmentally friendly as they cause little disturbance to the ground. The ground excavation is very little, so that soil disposal problems are significantly reduced. Recycled bars can also be used in the footings.

There will be some corrosion in connection with steel bars over an ex-tended period of time, however, as the stress within the bars is very low, about 2% of full capacity, the footing service life can easily be more than 50 years.

Another added advantage is that the footings can be pre-cast in the factory, can be brought to the site, and the entire footing can be inserted into the ground by applying a uniform pressure over or across the top of the slab using a pile driving equipment or a mobile press. Care should be taken, not to damage the concrete slab, using timber pieces or a suitable buffer on top of the concrete slab. The building column is then installed over the footing. This will reduce construction time dramatically.

The aforenoted footings may not be suitable for use within hard rocky ground as it will be difficult to push the anchor bars 1 into the rock.

Instead of deformed bars, we can use plain bars as well. But these plain bars have to be provided with a bent portion or hook at the top end portion embedded within the concrete slab, or a thicker concrete slab must be used to achieve optimal anchorage length. Similarly, instead of concrete slabs, steel plates can be used which can be welded to the bars.

Various embodiments under this invention are possible without deviating from the spirit of the invention such as:

The bars can be screwed into pre-cast concrete slab with ferrules embedded into concrete.

Threaded rods can be used in place of deformed bars.

Stainless steel bars can be used to reduce corrosion problems, although, these will be more expensive.

Partly or full length galvanized or epoxy coated deformed, plain or threaded steel bars can be used to reduce corrosion rates.

The upper ends of the bars top, encased within the concrete, can have hooks or L-shaped configurations so as to achieve bondage, especially in connection with plain bars which require more bonding length as compared to deformed bars.

Steel plates bolted or welded to bars, or timbers or plywood sheets, can be used in place of the concrete slabs.

Anchor bars can be installed in the lower portions of the pre-cast concrete slabs by drilling holes or bores therein and grouting the same with epoxy grout or another suitable chemical adhesive, or bolting the uppermost externally threaded portions of the bars to the concrete slab using ferrules.

The anchor bolts (hold-down bolts) can be U or L-shaped or plate welded at their base portions for cast-in-situ type, instead of the chemical or mechanical anchor type.

The anchor bolts can be mild steel or high strength steel bolts with threaded tops, can be cast-in-situ in the case of concrete, or can be firmly fixed by suitable means in the case of wood/plywood and steel plates.

The anchor bolts can be part of a pre-cast concrete slab, but they need to be protected while pushing the footing into the ground.

The anchor bolts can be of any shape—circular, triangular, square, rectangular, hexagonal, or the like, with any pattern or spacing.

Bars can be of any shape—circular, triangular, square, rectangular, hexagonal, or the like, with any pattern or spacing.

The footing slabs can also be of any shape—circular, triangular, square, rectangular, hexagonal, or the like.

The footing slab can be made using reinforced concrete, fiber reinforced concrete, or fiber reinforced plastic (FRP).

In short, the distinguishing features of the present invention soil anchor footing are noted hereinbelow:

Economical—30 to 40% cheaper than conventional concrete pad type footings.

Time saving—pre-cast footings can be installed in, for example, 30 minutes.

Environmentally friendly—very small excavation is required as compared to conventional footings, hence, little disturbance to the ground, less soil disposal, and less erosion control problems.

Space saving—the footings require much smaller spaces as compared to conventional concrete pad type footings. It will therefore be advantageous where space restriction is an issue and other footings are in close proximity.

The footings will result in or encounter less settlement as compared to conventional concrete pad type footings. It will therefore be advantageous for deflection sensitive equipment support.

These footings have much higher moment resistance capacities. It will therefore be advantageous in those situations where verticals load are small and overturning moments are high. Examples are electrical substation structures, light poles, sign posts, and the like.

The footings can be cast-in-situ, or they can be of the pre-cast, pre-formed, or pre-fabricated type depending upon the site requirement.

Recycled bars can also be used, as the stress in these bars is very low. It is also environmentally friendly to use recycled bars in addition to the result in cost saving.

The footings can have varied applications, such as, for example, electrical substation equipment supports, light poles, sign posts, light industrial structures, housing and small building columns, brick or concrete wall footings, retaining wall footings, railway infrastructure, pipe supports, pre-cast panel temporary supports, bollards, and the like.

I have brought out the novel features of the invention by explaining some of the preferred embodiments in accordance with the principles and teachings of the present invention so as enable to a person in the art to understand and appreciate the invention. It is also to be understood that the invention is not limited in its application to the details set forth in the above description or illustrated in the accompanying drawings. Although the invention has been described in considerable detail with particular reference to certain preferred embodiments thereof, variations and modifications can be effected within the spirit and scope of the invention as described herein above and as defined in the appended claims.

I claim:

1. A soil anchor footing slab assembly for supporting a load column above the ground at a predetermined ground site location which comprises solid ground not having pre-drilled holes formed therein for accommodating ground anchor rods, comprising:

a pre-cast footing slab, pre-cast at a location remote from a predetermined ground site location at which said pre-cast footing slab is to be affixed to the ground, having a substantially flat configuration with a planar upper surface and an opposed mutually parallel planar lower surface capable of supporting a desired load, wherein said pre-cast footing slab has a substantially uniform thickness and wherein a plurality of enlarged holes have been pre-formed within said pre-cast footing slab for receiving a plurality of first vertically oriented anchor bars;

said plurality of first vertically oriented anchor bars comprising elongated linear bars selected from the group comprising deformed steel bars, fiber reinforced polymer (FRP) bars, stainless steel bars, plain steel bars and threaded rods, have good soil anchorage capacity resulting in high down-ward and uplift resistance capacity with a footing end configured for ground penetration, are arranged within a predetermined two-dimensional pattern wherein upper end portions of said plurality of first vertically oriented anchor bars are adapted to be embedded within said pre-cast footing slab as a result of said plurality of first vertically oriented anchor bars being inserted into and through said plurality of enlarged holes defined within said pre-cast footing slab by apparatus selected from the group comprising a hammer, pile driving equipment, and a mobile press, until upper end portions of said plurality of first vertically oriented anchor bars are flush with said upper surface portions of said pre-cast footing slab or disposed slightly below said upper surface portions of said pre-cast footing slab or about 50 mm above said upper surface portions of said pre-cast footing slab while lower end portions of said plurality of first vertically oriented anchor bars are inserted into the solid ground not having pre-drilled holes therein so as to extend vertically downwardly into the ground for supporting said pre-cast footing slab and for effectively attaching said pre-cast footing slab to the ground so as to resist uplift and downward forces;

means disposed within upper portions of said plurality of enlarged holes defined within said pre-cast footing slab and annularly surrounding said upper end portions of said plurality of first vertically oriented anchor bars for effectively connecting said plurality of first vertically oriented anchor bars to said pre-cast footing slab and wherein all of said upper end portions of said first vertically oriented anchor bars are effectively connected together by means of said pre-cast footing slab; and a plurality of second bars having lower end portions thereof embedded within upper surface portions of said pre-cast footing slab while upper end portions of said plurality of second bars project vertically upwardly above said upper surface portions of said pre-cast footing slab for embedment within and connection to a load column to be mounted upon, secured to, and supported by said pre-cast footing slab.

2. A soil anchor footing slab assembly as defined in claim 1, wherein:

the size of said pre-cast footing slab, the thickness of said pre-cast footing slab, the diameter of each one of said first vertically oriented anchor bars, the length of each one of said first vertically oriented anchor bars, the number of said first vertically oriented anchor bars, the spacing defined between adjacent ones of said first vertically oriented anchor bars, the strength of the concrete comprising said pre-cast footing slab, when it is used, and the depth to which said first vertically oriented anchor bars are embedded within the ground and said pre-cast footing slab are predetermined based upon column base forces and structural analysis.

3. A soil anchor footing slab assembly as defined in claim 1, wherein:

the material of said pre-cast footing slab is selected from concrete, reinforced concrete, fiber reinforced concrete, fiber reinforced plastic, steel plate, timber, and plywood;

said pre-cast footing slab has a geometrical cross-sectional configuration selected from the group comprising circular, triangular, square, rectangular and hexagonal; and said pre-cast footing slab is preferably concrete which has a thickness of about 150 mm to 400 mm.

4. A soil anchor footing slab assembly as defined in claim 1, wherein:

said first vertically oriented anchor bars are selected from the group comprising deformed steel bars, also known as rebar, plain steel bars, threaded bars, raw bars, galvanized bars, epoxy coated, partly or fully along the length of said first vertically oriented anchors bars, stainless steel bars, and fiber reinforced polymer (FRP) bars.

5. A soil anchor footing slab assembly as defined in claim 1, wherein:

said first vertically oriented anchor bars have any standard cross-sectional configuration selected from the group comprising circular, triangular, square, rectangular, and hexagonal, and are provided with plain or threaded end portions for embedment within said pre-cast footing slab.

6. A soil anchor footing slab assembly as defined in claim 1, wherein:

said pre-cast footing slab has a stepped configuration provided with a pedestal at its center.

7. A soil anchor footing slab assembly as defined in claim 1, wherein:

the thickness of said pre-cast footing slab is within the range of 150 mm to 400 mm, while the length of each one of said first vertically oriented anchor bars within said pre-cast footing slab is determined by the force in said first vertically oriented anchor bars.

8. A soil anchor footing slab assembly as defined in claim 1, wherein:

each one of said first vertically oriented anchor bars has a length 0.3 to 2 meters, with a diameter of 12 mm to 36 mm, and are placed in a grid pattern which is about 0.3 m×0.3 m to 1 m×1 m in plan area with said plurality of first vertically oriented anchor bars being spaced from each other by distances of 100 mm to 300 mm as measured from center-to-center points of adjacent ones of said first vertically oriented anchor bars.

9. A soil anchor footing slab assembly as defined in claim 1, wherein:

said plurality of second bars are fabricated from mild steel or high strength steel, have any standard cross-sectional configurations selected from the group comprising circular, triangular, square, rectangular, and hexagonal, comprise deformed bars with threaded tops or threaded rods, are raw or galvanized or stainless steel, and are provided with bent, cogged, or hooked ends for embedment within said pre-cast footing slab.

10. A soil anchor footing slab assembly as defined in claim 1, wherein:

said plurality of second bars are fabricated from mild steel or high strength steel, have any standard cross-sectional configurations selected from the group comprising circular, triangular, square, rectangular, and hexagonal, comprise deformed bars with threaded tops or threaded rods, are raw or galvanized or stainless steel, and are bolted to said pre-cast footing slab or bolted or welded to wood or plywood, fiber reinforced plastic, or steel plate operatively connected to said pre-cast footing slab so as to be firmly secured to said pre-cast footing slab.

11. A soil anchor footing slab assembly as defined in claim 1, wherein:

said pre-cast footing slab assembly is used to support said load column which is selected from the group comprising a steel or concrete column, a concrete/brick/block wall, a light post, a bollard, an electrical substation equipment support, a railway infrastructure support, a pipe support, a sign post, a post structure, a pre-cast panel support, a light industrial structure column, a house or small building column, a retaining wall footing, and similar structures.

12. The soil anchor footing slab assembly as set forth in claim 1, wherein:

said means disposed within said upper portions of said plurality of enlarged holes defined within said pre-cast footing slab and annularly surrounding said upper end portions of said plurality of first vertically oriented anchor bars for fixedly connecting said plurality of first vertically oriented anchor bars to said pre-cast footing slab is selected from the group comprising an epoxy grout, a chemical adhesive, threaded ferrules, or nuts and washers.

13. A method for forming a soil anchor footing slab assembly upon a predetermined ground site location for supporting a load column, wherein the predetermined ground site location comprises solid ground not having pre-drilled holes formed therein for accommodating ground anchors, comprising the steps of:

preparing a portion of ground by excavating a predetermined ground site location upon which a footing slab is to be located;

positioning a pre-cast footing slab, pre-cast at a location remote from the predetermined ground site location at which said pre-cast footing slab is to be affixed to the ground, having a substantially flat configuration with a planar upper surface and an opposed mutually parallel planar lower surface capable of supporting a desired load, upon the desired location site at which said pre-cast footing slab is to be located, wherein enlarged holes have been pre-formed within said pre-cast footing slab for receiving a plurality of first vertically oriented anchor bars comprising elongated linear bars selected from the group comprising deformed steel bars, fiber reinforced polymer (FRP) bars, stainless steel bars, plain steel bars, and threaded rods, having good soil anchorage capacity resulting in high downward and uplift capacity resistance with a footing end configured for ground penetration, and arranged within a predetermined two-dimensional pattern;

pushing said plurality of first vertically oriented anchor bars, by using apparatus selected from the group comprising a hammer, pile driving equipment, and a mobile press, through said enlarged holes defined within said pre-cast footing slab, whereby lower end portions of said plurality of first vertically oriented anchor bars enter the ground not having pre-drilled holes formed therein while upper end portions of said plurality of first vertically oriented anchor bars are embedded within said pre-cast footing slab such that said upper end portions of said plurality of first vertically oriented anchor bars are flush with said upper surface portions of said pre-cast footing slab or disposed slightly below said upper surface portions of said pre-cast footing slab or about 50 mm above said upper surface portions of said pre-cast footing slab while lower end portions of said plurality of first vertically oriented anchors bars extend vertically downwardly into the ground for effectively securing said pre-cast footing slab to the ground and thereby resisting uplift and downward forces;

affixing said upper end portions of said plurality of first vertically oriented anchor bars to said pre-cast footing slab, by means disposed within upper portions of said plurality of enlarged holes defined within said pre-cast footing slab and annularly surrounding said upper end portions of said plurality of first vertically oriented anchor bars, such that all of said first bars are affixed to said pre-cast footing slab and are effectively connected together by means of said pre-cast footing slab; and fixing a plurality of second bars into upper surface portions of said pre-cast footing slab such that lower end portions of said second bars are embedded within upper surface portions of said pre-cast footing slab while upper end portions of said second bars project vertically upwardly above said upper surface portions of said pre-cast footing slab so as to be embedded within and fixedly secure a load column to said upper surface portions of said pre-cast footing slab.

14. A method for making a soil anchor footing slab assembly as defined in claim 13, further comprising the steps of:

screeding a thin layer of sand upon the excavated ground so as to level the surface of the ground; and filling areas of said pre-formed holes, defined within said footing slab and disposed around said plurality of first bars, with an epoxy grout or a chemical adhesive.

15. A method for making a soil anchor footing slab assembly as defined in claim 13, wherein:

the material of said pre-cast footing slab is selected from concrete, reinforced concrete, fiber reinforced concrete, fiber reinforced plastic, steel plate, timber, and plywood; and said plurality of first vertically oriented anchor bars are bolted or welded to said pre-cast footing slab when said pre-cast footing slab comprises a steel plate portion.

16. A method for making a soil anchor footing slab assembly as defined in claim 15, wherein:

said plurality of first vertically oriented anchor bars are bolted to said pre-cast footing slab when said pre-cast footing slab comprises a concrete, reinforced concrete, fiber-reinforced concrete, fiber-reinforced plastic, plywood, or timber portion.

17. A method for making a soil anchor footing slab assembly as defined in claim 13, wherein;

said plurality of second bars are inserted into holes drilled into upper surface portions of said pre-cast footing slab and are bonded within said pre-cast footing slab by a chemical adhesive, or are fixedly secured within said upper surface portions of said pre-cast footing slab as a result of said plurality of second bars being screwed into expandable ferrules disposed within said holes drilled into said upper surface portions of said pre-cast footing slab.

18. A method for forming a soil anchor footing slab assembly as set forth in claim 13, wherein:

said means disposed within said upper portions of said plurality of enlarged holes defined within said pre-cast footing slab and annularly surrounding said upper end portions of said plurality of first vertically oriented anchor bars for fixedly connecting said plurality of first vertically oriented anchor bars to said pre-cast footing slab is selected from the group comprising an epoxy grout, a chemical adhesive, threaded ferrules, or nuts and washers.

* * * * *